United States Patent [19]

Kinney

[11] 4,185,690

[45] Jan. 29, 1980

[54] BACKSURGE WELL CLEANING TOOL

[75] Inventor: Charles W. Kinney, Houston, Tex.

[73] Assignee: Baker International Corporation, Orange, Calif.

[21] Appl. No.: 915,041

[22] Filed: Jun. 12, 1978

[51] Int. Cl.[2] ..... E21B 33/10; E21B 21/00

[52] U.S. Cl. ..... 166/183; 166/188; 166/319

[58] Field of Search ..... 166/133, 129, 188, 183, 166/319; 137/628, 613

[56] References Cited

U.S. PATENT DOCUMENTS

| | | | |
|---|---|---|---|
| 2,676,661 | 4/1954 | Crooke, Jr. | 166/319 |
| 2,742,093 | 4/1956 | Vaughn | 166/188 |
| 3,826,309 | 7/1974 | Tausch | 166/319 |

*Primary Examiner*—James A. Leppink

*Attorney, Agent, or Firm*—William C. Norvell, Jr.

[57] ABSTRACT

Apparatus is run on tubing string for pressure surging operations. Fluid is in the annular area between the tubing string and the well bore and fluid is also within the tubing string with a packer separating the annulus fluid from the tubing fluid. A first valve body contains means for connecting the valve body to the tubing string and has flapper valve head means normally blocking fluid flow through the first valve body. A valve seat is carried on the first valve body. A first piston is responsive to pressurization of the annulus fluid to shift the flapper valve head away from the seat to allow fluid flow through the first valve body. Locking means are carried on the first valve body to prevent longitudinal shifting of the first piston in at least one direction after the piston is shifted to open the first valve. A second valve body is responsive to tubing pressure and contains first lock means for locking a seal means therein to isolate the central bore. A by-pass is defined on the second valve body and is closed by location of second piston means selectively sealingly located thereacross. The second piston means is responsive to pressurization of the tubing fluid to move the piston in a first direction to a first position to open the fluid by-pass. Means for locking the second piston in a first position are on the piston and the second valve body. A cylindrical tubular air chamber communicates between the valve bodies.

6 Claims, 13 Drawing Figures

BACKSURGE WELL CLEANING TOOL

BACKGROUND OF THE INVENTION

1. Field of the Invention

The invention relates to a tool utilized to remove particulate matter from within perforations and the like in a subterranean well.

2. Description of the Prior Art

During the flow of production into a well bore, or while injecting water, and the like, into formations in the performance of secondary or tertiary recovery operations, perforations in the well bore or the face of the formations may oftentimes become plugged with sand, silt, or other substances, restricting fluid flow between the formation and the well bore. Heretofore, it has frequently been common practice to utilize a valve apparatus adapted to be opened to create a high pressure differential which results in a sudden high velocity flow of the formation fluid through the perforations and into the well bore, thereby carrying sand, silt, and the like, into the tubing for elevation to the top of the well. As a result, the formation and the perforations are washed or cleared, facilitating subsequent well production or the injection of secondary or tertiary recovery fluids into the formation.

Some of the prior art backsurge valving assemblies require drill or workstring rotation to manipulate one or more of the valves. Such mechanically-activated manipulation may be undesirable in deviated holes and/or in wells of extreme depth. Moreover, some valving assemblies heretofore utilized in backsurge systems incorporate a diaphragm or disc-like element as a valve head which is ruptured by pressure or is "cut" to open the valve, thus possibly contributing to foreign particulate matter in the well which also could adversely affect subsequent operation of the valve assembly by becoming positioned or jammed between two moving parts, etc.

The present invention obviates many of the problems associated with the prior art by providing a backsurge well cleaning tool which is activated by pressure, does not require tubing rotation for valve manipulation, and which does not contain rupturable or cuttable disc elements as valve seats.

SUMMARY OF THE INVENTION

The present invention incorporates a valve apparatus which is disposable in a tubing string in a subterranean well bore for performing pressure surging operations. Fluid is present in the annular area between the tubing string and the well bore, while fluid is also present within the tubing string. Means for selectively pressurizing the annular fluid and the tubing fluid are provided. The apparatus, in general, provides packer means for separating the annulus fluid from the tubing fluid. A first valve body having means for connection to the tubing string also contains flapper valve head means normally blocking fluid flow through the first valve body. Valve seat means are carried on the first valve body for selective sealing engagement with the flapper valve head means. A first piston is carried by the first valve body and is responsive to pressurization of the annulus fluid to shift the flapper valve head means away from sealing engagement with the valve seat means to allow fluid flow through the first valve body. Locking means are carried by the first valve body for locking engagement with the first piston after the flapper valve head means is shifted away from sealing engagement with the valve seat means to prevent longitudinal shifting of the first piston in at least one direction.

A second tubular body having a central bore is provided and is connected to the tubing string. The second tubular body provides first lock means, and seal means which are selectively sealingly lockable with the second tubular body and has second lock means carried thereon, the seal means preventing fluid flow through the central bore of the second valve body. A fluid by-pass is carried on the second tubular body, and second sealing piston means selectively cover the by-pass. The second piston means are shiftably responsive to pressurization of tubing fluid to shift in a first direction to a first position to open the fluid by-pass and permit fluid communication therethrough. Lock means are provided for locking the second piston means in a first position.

A cylindrical tubular air chamber is located between the first and second valve bodies and communicates with said valve bodies to provide an atmospheric pressure chamber for the pressure surging operation.

DESCRIPTION OF THE PREFERRED EMBODIMENTS

Figure 1A:
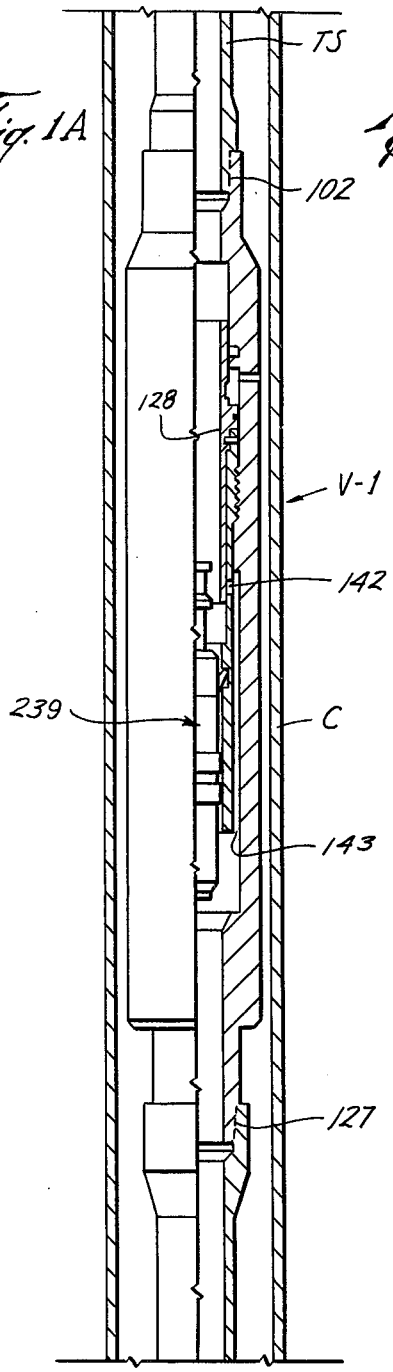
FIGS. 1A, 1B and 1C together constitute a longitudinal schematic view illustrating the present apparatus after the apparatus has been run into the well, the packer being anchored and set against the casing, and each of the valves being in closed position.
Figure 2A:
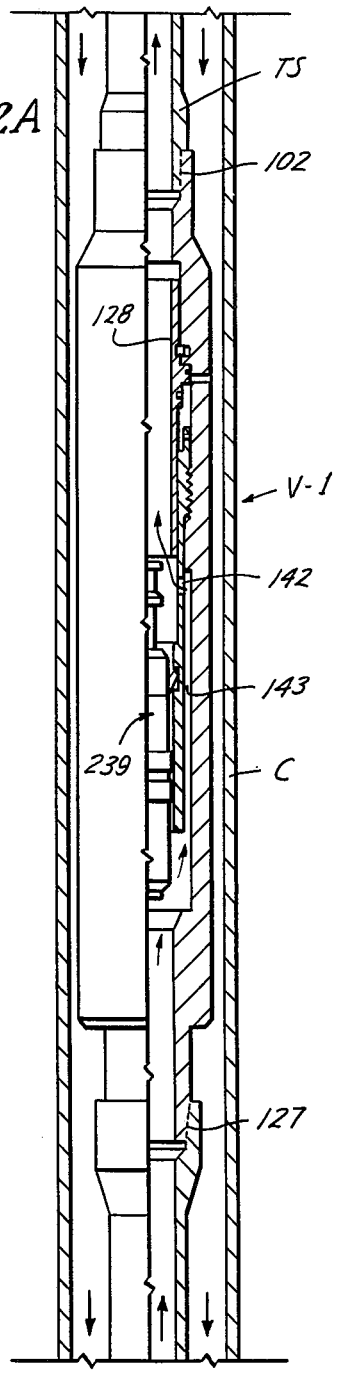
FIGS. 2A, 2B and 2C are similar to the views illustrated in FIGS. 1A, 1B and 1C, showing each of the upper and lower valves in open position with reverse circulation being initiated to clean out the well bore, subsequent to the cleaning operation, the packer being released from the casing.
Figure 1B:
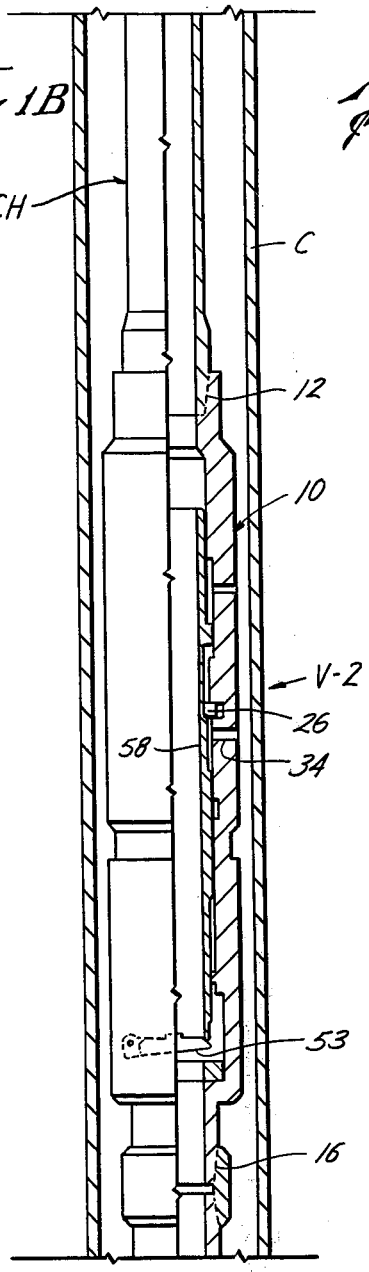
Figure 2B:
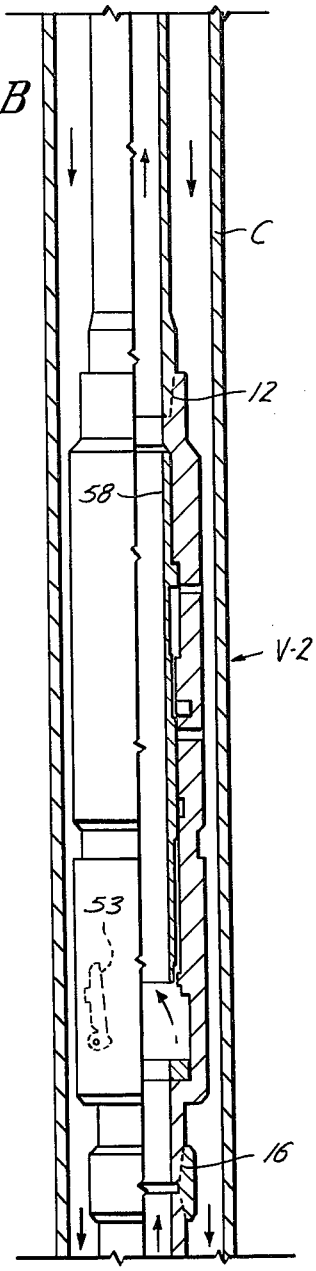
Figure 1C:
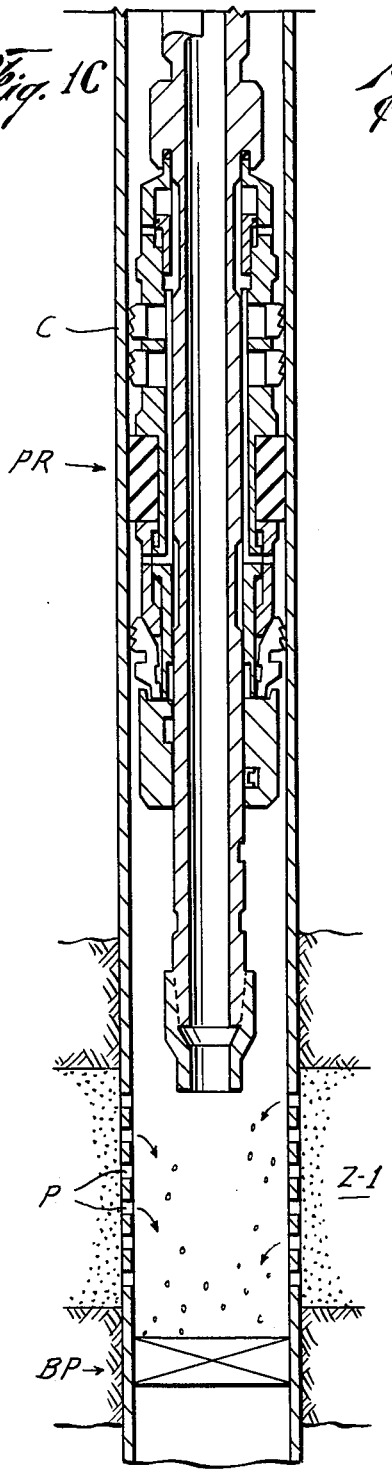
Figure 2C:
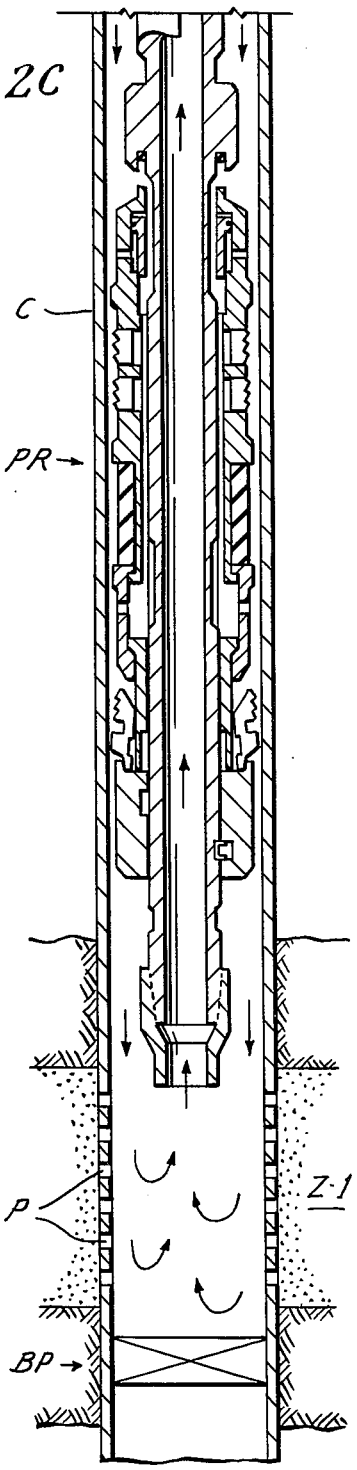

Referring now to FIGS. 1A, 1B and 1C, a tubing string TS is lowered into a well bore having a casing C. The tubing string TS carries an upper valve assembly V1 and a lower valve assembly V2, the valve assemblies V1 and V2 being separated by an atmospheric pressure chamber CH. The tubing string TS is terminated at its lower end by a conventional packer assembly PR which is designed to hold pressure from above and below. The tubing string TS is run into the well, and the packer PR landed immediate a bridge plug BP within the bore of the well and above perforations P which are to be cleaned of particulate contamination within production zone Z1.

Figure 3A:
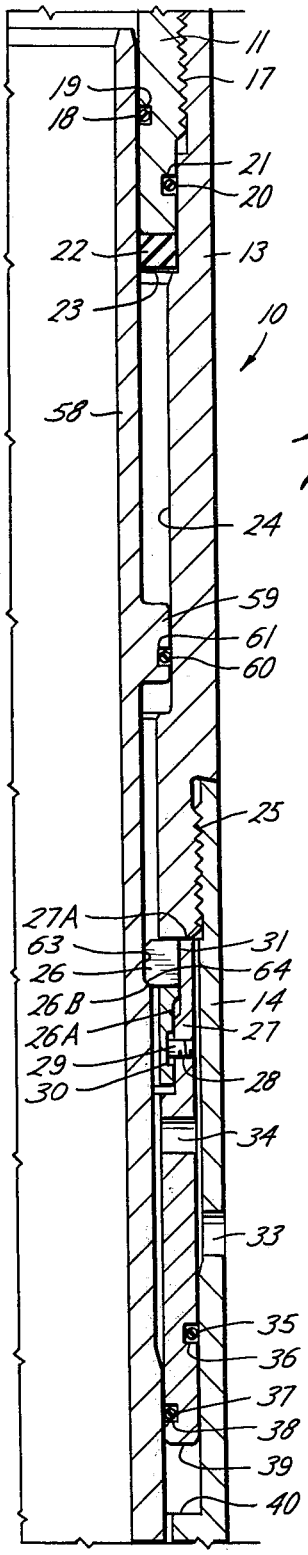
FIGS. 3A and 3B together constitute an enlarged sectional view of the lower valve assembly in closed position, prior to the initiation of the cleaning operation.
Figure 4A:
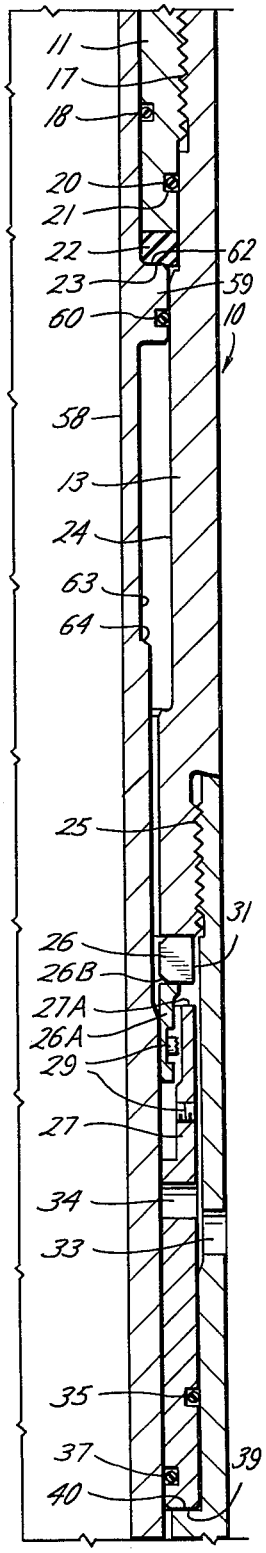
FIGS. 4A and 4B illustrate the lower valve assembly in open position, to expose the production zone to the atmospheric pressure chamber.
Figure 3B:
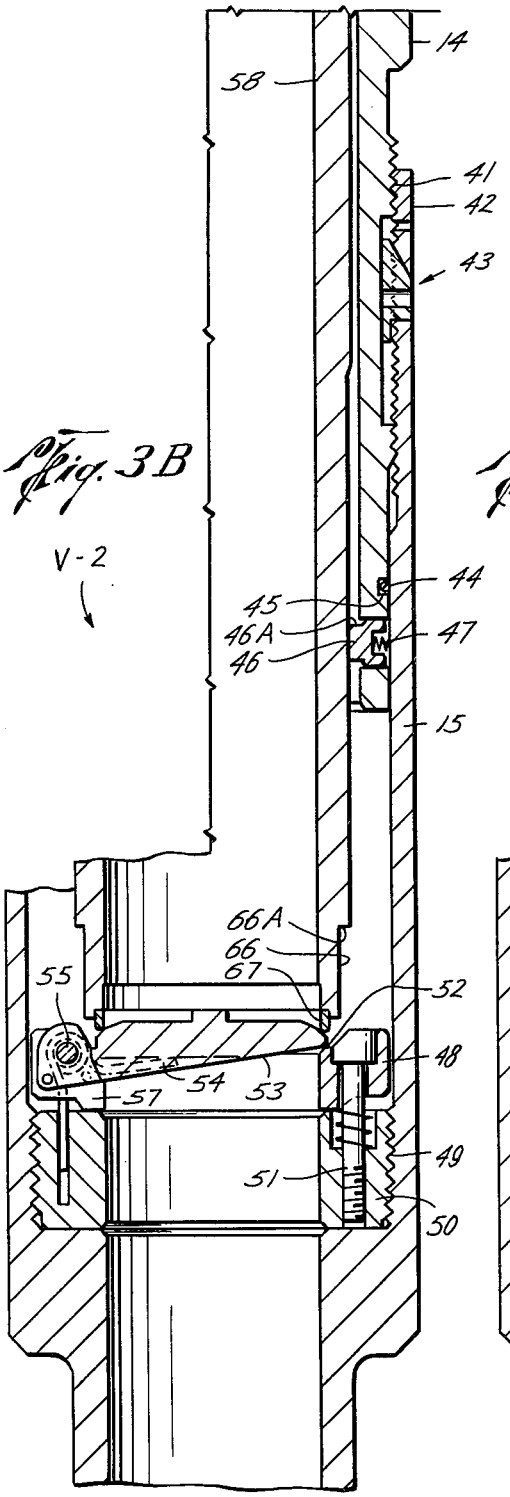
Figure 4B:
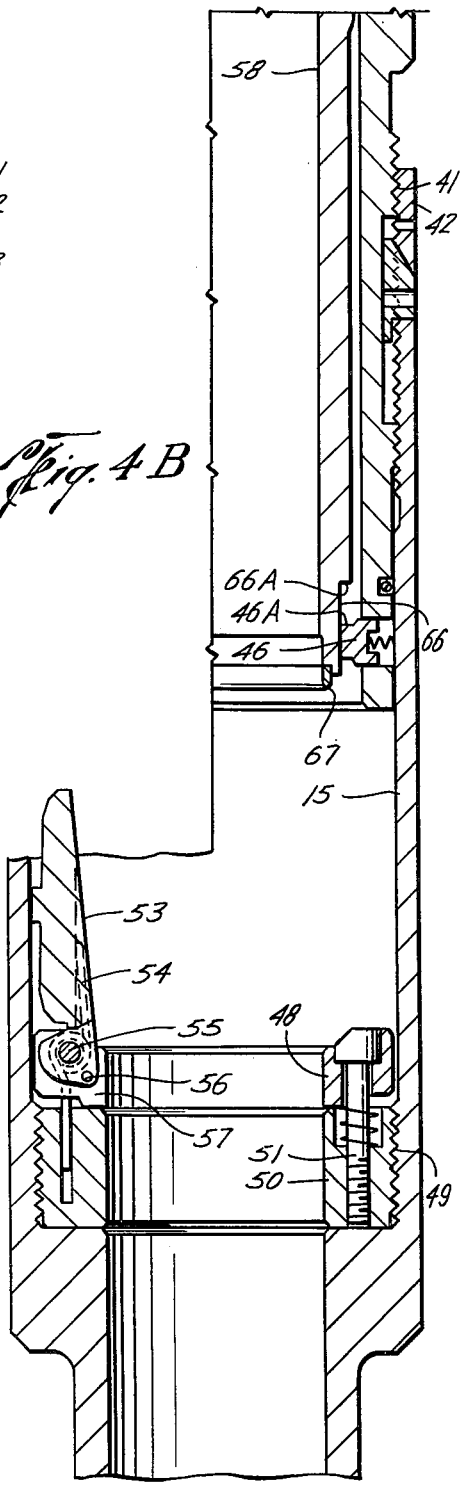

As particularly illustrated in FIGS. 1B, 3A and 3B, the lower valve assembly V2 basically is comprised of an outer longitudinally extending housing 10 containing an extended piston mandrel 58 therein. The housing 10 is defined at its uppermost end by a top sub 11 which is secured by threads 12 to the lowermost tubular section forming the pressure chamber CH thereabove. The outer housing 10 continues lowerly of the top sub 11 by means of a piston housing 13 which is secured at threads 17 to the top sub 11. A connector element 14 continues the outer housing 10 lowerly of the piston housing 13, the connector element 14 being secured to the housing 13 by means of threads 25. The outer housing 10 is terminated at its lowermost end by a valve housing 15 which is secured to the connector 14 by means of threads 41, rotational movement between the valve housing 15 and the connector element 14 being prevented by utilization of a key assembly 43 inserted within the valve housing 15 to the connector 14, the key assembly 43 being secured in place by the jam ring 42. The valve housing 15 is secured by means of threads 16 either to a pup joint or other tubular member, or to the upper end of the packer PR.

The top sub 11, in addition to having threads 17 defined thereon for securement of the piston housing 13 therebelow, also has an interiorly circumferentially defined grooveway 19 for housing of an elastomeric ring element 18 to prevent fluid communication between the top sub 11 and the piston mandrel 58. A similar grooveway 21 and ring element 20 also are defined on the top sub 11 to prevent fluid communication between the top sub 11 and the piston housing 13. A spacer or shock absorber 22 having a lower face 23 is carried by the top sub 11 at its lowermost end and defines the limit of upward travel of a piston head 59 carried by the piston mandrel 58 as the valve V2 is manipulated to open position.

The piston housing 13 has a smooth inner wall 24 for slidable longitudinal carriage thereacross of the piston head 59 as the valve V2 is manipulated to open position. Somewhat below the inner wall 24 and immediately interior of the connector 14 are a series of inwardly contracted ring segments 26 having their inner face resting upon a shoulder 63 on the piston mandrel 58. The segments 26 are shearably secured to a longitudinally extending segment retainer 27 carried within the outer housing 10 between the connector 14 and the piston mandrel 58, the segments 26 being secured to the retainer 27 by means of a guard 26A, the guard 26A receiving within a groove 30 thereof a shear screw 29 which is inserted through the segment retainer 27 by means of a bore 28. When the segments 26 shoulder upon the shoulder 63 of the piston mandrel 58, the upper longitudinal end 27A of the segment retainer 27 is permitted to be positioned upwardly and over the segments 26 and contact the lower end of the piston housing 13, and, with the shear screw 29 engaging the guard 26A, the segments 26 are urged interiorly of the segment retainer 27, such that a beveled shoulder 64 on the piston mandrel 58 contacts and shoulders upon a companion stop 26B on the segments so that upward longitudinal movement of the piston mandrel 58 is arrested.

When in engaged position, the outer segment face 31 is interfaced with the upper end 27A of the segment retainer 27.

The segment retainer 27, normally locked interior of the connector 14 as described above, contains a latitudinal port 34 defined thereacross which is always in communication with a companion port 33 in the connector 14, the ports 33 and 34 communicating to the annular area between the casing C and the outer housing 10 to permit annulus pressure to selectively act upon the piston head 59 and the segment retainer 27 when it is desired to manipulate the valve V2 to open position.

An elastomeric O-ring 37 contained within a groove 38 on the lowermost end of the segment retainer 27 prevents fluid communication between the piston mandrel 58 and the segment retainer 27, while a similar O-ring 35 contained within its groove or boreway 36 on the segment retainer 27 prevents fluid communication between the retainer 27 and the connector 14.

The lowermost end 39 of the segment retainer 27 will, upon activation of pressure upon the segment retainer 27 and the piston head 59, shift the segment retainer 27 longitudinally downwardly, until such time as the end 39 rests upon an upwardly facing companion shoulder 40 on the connector 14.

The connector 14, secured to the valve housing 15 by threads 41 and key 43, has an elastomeric O-ring 44 circumferentially contained within a groove 45 defined within the connector 14 to prevent fluid communication between the connector 14 and the valve housing 15. Immediately below the ring 44 on the connector 14 is a limit pin 46 which is urged inwardly toward the piston mandrel 58 by means of a compressive spring element 47 carried exterior and circumferentially around the limit pin 46. When the valve V2 is in closed position, the limit pin 46 will protrude inwardly away from the connector 14 and toward the piston mandrel 58. However, when the valve V2 is shifted to open position and the piston mandrel 58 is longitudinally manipulated upwardly within the housing 10, the limit pin 46 will be urged by the spring 47 into a limit lock 66 at the lowermost end of the piston mandrel 58, whereby the upper outer face 46A of the limit pin 46 will rest and encounter a companion shoulder 66A on the piston mandrel 58 to lock the piston mandrel 58 in the "up" position.

The valve housing 15 contains a flapper-type valving assembly which normally is maintained closed by the longitudinal position of the piston mandrel 58. The flapper valve assembly consists of a flapper head 53 which, when in closed position, completely bridges the internal diameter of the outer housing 10 at the bottom sub 15, the flapper head 53 lowerly resting upon a lip 52 of a locator ring 48 which is selectively spaced with respect to the flapper head 53 by means of a bushing 50 which is secured to the valve housing 15 by means of threads 49 and to the locator ring 48 by means of a spring loaded adjustment shaft 51 protruding longitudinally therethrough.

A valve ring 67 carried around the lowermost end of the piston mandrel 58 securely seals the flapper head 53 with respect to the mandrel 58 when the head 53 is in the closed position, bridging the interior of the outer housing 10. A spring pin 54 contacts the high pressure face side of the flapper head 53 and is carried around a retainer pin 55 within a retainer element 57, which, in turn, is housed within the locator ring 48, to urge and shift the flapper head 53 away from the piston mandrel 58 when the valve V2 is manipulated to open position, such that the flapper-type valving assembly is fully open with respect to the internal diameter of the outer housing 10 of the valve V2 at the valve housing 15. A spring loaded retainer pin 56 is carried within the spring retainer 57 and in the locator ring 48, and is shifted to locked position within the ring 48 when the flapper head 53 is shifted to open position to prevent inadvertent movement of the flapper head 53 toward the "closed" position, as the result of pressure surges, or the like.

The piston mandrel 58 is carried within the outer housing 10 and has at its upper end a piston head 59 which is permitted to slide longitudinally along the inner smooth wall 24 of the piston housing 13 as the valve V2 is manipulated to the open position, a circumferentially extending elastomeric O-ring seal element 60 being contained within its grooveway 61 on the piston head 59 to prevent fluid communication between the piston head 59 and the piston housing 13. As the piston mandrel 58 is shifted upwardly toward the top sub 11 as the valve V2 is manipulated to the open position, the upper end 62 of the piston head 59 will encounter the lower face 23 of the shock absorber 22, which defines the upper limit of longitudinal travel of the piston head 59.

Below the piston head 59 on the mandrel 58 is an outwardly beveled shoulder 64 which normally receives a portion of the lower face of the segments 26, whereby the piston mandrel 58 is locked against upward movement prior to activation. The segments 26 also rest within a groove 63 defined on the mandrel 58 between the shoulder 64 and the piston head 59.

The piston mandrel 58 has at its lowermost end an engrooved limit lock 66 for selective receipt of the limit pin 46 as the piston mandrel 58 is shifted longitudinally upwardly, the interface of the limit lock 66 and the pin 46 permitting the piston mandrel 58 to be locked in the "up" position.

An elastomeric flapper valve ring 67 is carried at the lowermost tip of the piston mandrel 58 for sealing engagement with the flapper head 53.

Figure 5A:
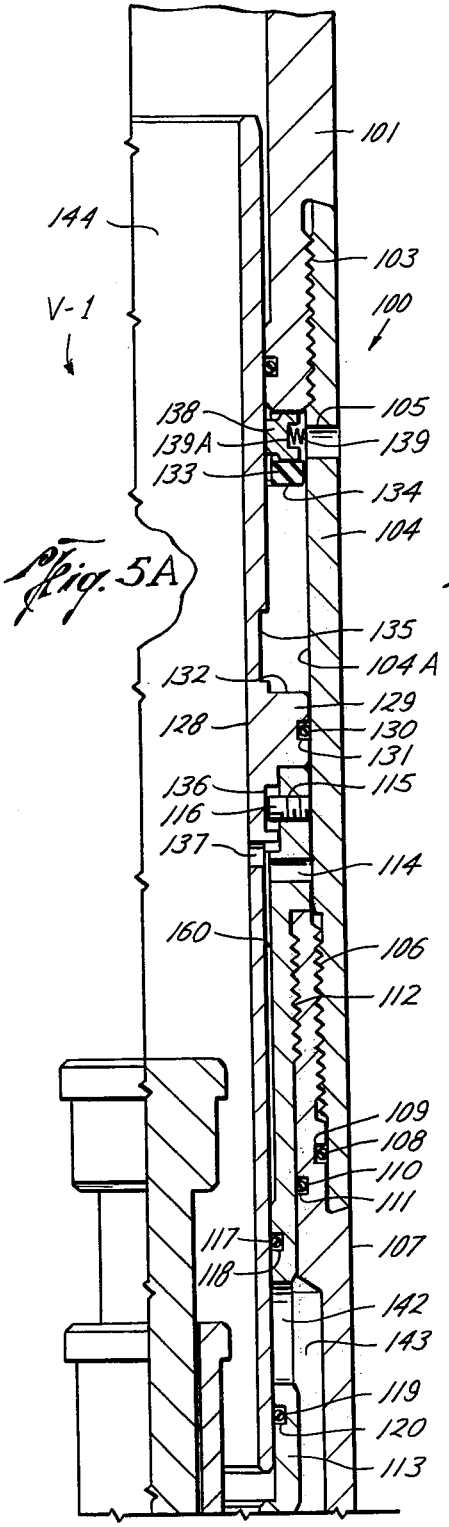
FIGS. 5A and 5B constitute an enlarged sectional view illustrating the upper valve assembly in closed position.
Figure 6:
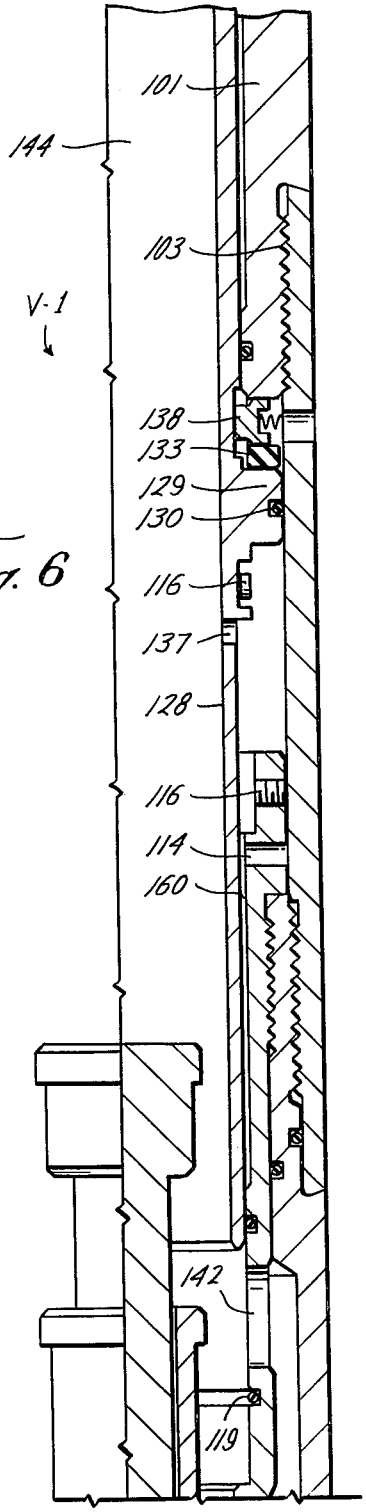
FIG. 6 is an enlarged longitudinal sectional view similar to those illustrated in FIGS. 5A and 5B, showing the upper valve assembly in open position to provide a passageway therethrough for reverse circulation of fluid to remove debris from the well bore.
Figure 5B:
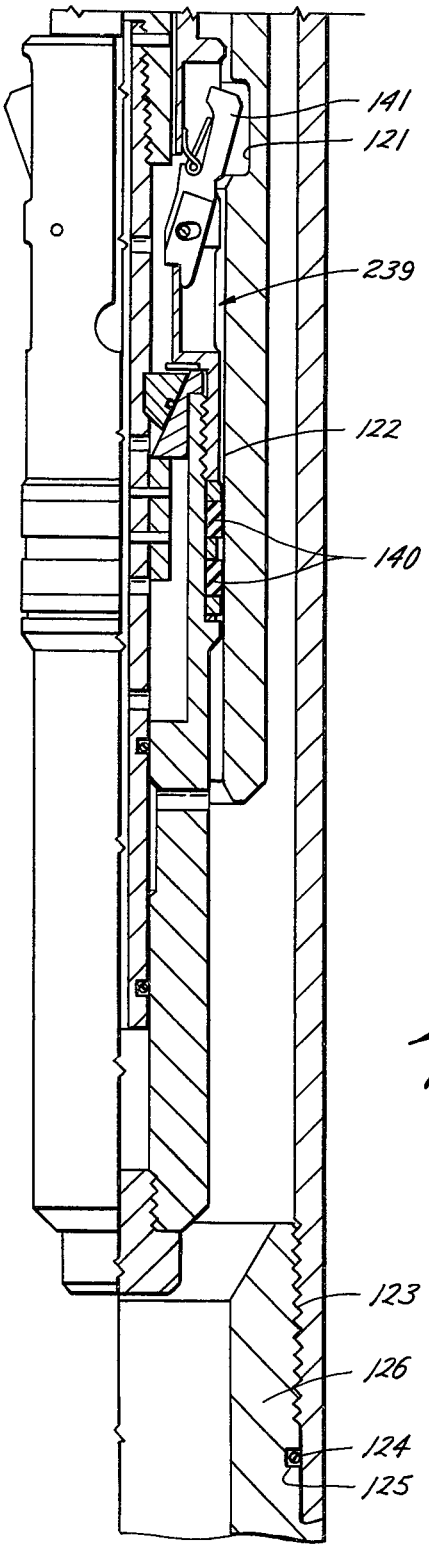

Referring now to FIGS. 1A, 5A and 5B, the upper valve V1 basically consists of an outer housing 100 cylindrically extending around a longitudinally elongated piston element 128. The outer housing 100 consists of a top sub 101 at its uppermost end which is secured by means of threads 102 to the lower end of the tubing string TS. The top sub 101 is secured by threads 103 to a cylindrical piston housing 104 therebelow. A transverse port 105 communicating with the annulus between the upper valve V1 and the casing C is defined across the uppermost end of the piston housing 104 below the threads 103 and permits annular pressure to act upon the upper face 132 of a piston head 129 carried on the piston 128 to permit shifting of the piston 128 longitudinally to manipulate the valve V1 to open position.

The top sub 101 contains at its lowermost end a contractable pin element 138 circumferentially extending around the upper portion of the piston 128, the pin 138 normally being secured around the exterior of the piston 128 by means of an inwardly urging spring element 139 encased within a groove 139A on the exterior of the pin 138. Immediately below the pin 138 is an elastomeric shock absorber 133 which absorbs shock transmitted through the piston head 129 as the piston 128 is shifted longitudinally upwardly during manipulation of the valve V1 to open position. The lower face 134 of the shock absorber 133 will define a no-gas means as the upper face 132 of the piston head 129 encounters the shock absorber 133.

The housing 104 is secured by threads 106 to a cylindrical central housing 107 therebelow. An elastomeric O-ring seal element 108 is circumferentially carried within its bore 109 in the central housing 107 to prevent fluid communication between the central housing 107 and the piston housing 104.

The central housing 107, in turn, is secured by means of threads 123 to a bottom sub 126 therebelow, an elastomeric ring 124 being carried within a grooveway 125 therefor to prevent fluid communication between the bottom sub 126 and the central housing 107. The bottom sub 126, which defines the lowermost end of the outer housing 100, is secured by means of threads 127 to the upper section of the chamber CH.

The central housing 107 carries interiorly thereof a seal sleeve 113 which is secured to the central housing 107 by means of threads 112, an elastomeric O-ring seal element 110 being carried within its grooveway 111 on the central housing 107 to prevent fluid communication between the central housing 107 and the seal sleeve 113. At the uppermost end of the seal sleeve 113 is a transverse port 114 which always is in communication with a port or passageway 137 on the piston 128, the port 137 communicating with the internal diameter of the upper valve V1, the port 137 receiving tubing pressure for activation of the valve V1.

The sleeve 113 is secured to the piston element 128 by means of a shear pin 116 carried within a bore 115 on the sleeve 113, the shear pin 116 extending through a companion shear pin groove 136 on the piston element 128.

The piston element 128 contains a piston head 129 having its upper face 132 which interfaces with the lower face 134 of the elastomeric shock absorber 133 when the piston element 128 is shifted longitudinally during the manipulation of the valve V1 to open position. An elastomeric O-ring seal 130 is carried within a grooveway 131 on the piston head 129 to prevent fluid communication between the piston head 129 and the piston housing 104, the ring 130 exteriorly sliding along the smooth wall 104A of the piston housing 104 as the piston element 128 is shifted upwardly. A longitudinally cut groove 135 is defined on the piston element 128 immediately above the piston head 129 for receipt of the pin 138 as the piston element 128 is shifted upwardly and the groove 135 comes into alignment with the pin 138, the spring 139 shifting and urging the pin 138 into locked engagement within the groove 135 to prevent the piston element 128 from being shifted downwardly as a result of pressure surges, and the like.

An elastomeric O-ring seal element 117 is carried within its grooveway 118 defined on the sleeve 113, a longitudinally extending passage 160 being defined between the sleeve 113 and the piston element 128 between the rings 130 and 117, thus providing an effective piston area which is activated by tubing pressure being transmitted thereinto through the port 137. Rings 108 and 110 also define the lower end of the effective piston area.

A port or valve opening 142 is defined transverse within the sleeve 113 lowerly of the ring 117, a companion ring 119 carried within a bore 120 in the sleeve 113 below the port 142 preventing fluid communication between the sleeve 113 and the piston element 128 below the port 142.

A longitudinally extending passage 143 is defined between the central housing 107 and the sleeve 113, the positioning of the piston element 128 across the port 142 isolating the passage 143 from the interior 144 of the upper valve V1.

The sleeve 113 also contains a shouldered engroovement 121 which selectively receives the key 141 of a blanking plug assembly 239, of conventional construction, the plug 239 being run into position with the upper valve V1 prior to running the valve V1 into the well. A conventional seal assembly 140 is carried on the outer housing of the plug 239 and seals against the smooth wall 122 of the sleeve 113 to prevent fluid communication between the plug 239 and the sleeve 113.

OPERATION

When it is desired to clean debris immediate the perforations P within the zone Z1, the backsurge apparatus of the present invention is run on a tubing string TS with the blanking plug 239 being in set and sealed position within the valve assembly V1. The valve assembly V1, being affixed to the tubing string TS, is carried down into the well in its closed position, as shown in FIG. 1A. A series of tubular sections are carried below the valve assembly V1 to define the atmospheric chamber CH.

The lower valve assembly V2 is secured below the lowermost tubular section forming the chamber CH, the valve assembly V2 being in closed position. The packer PR is affixed to the lowermost end of the valve assembly V2.

Referring now to FIGS. 1A, 1B and 1C, the assembly is carried into the well and the lower end of the packer PR is located immediate the perforations P a known distance from the set bridge plug BP. Thereafter, the packer PR is set to isolate the annulus between the casing C and the packer PR above the zone Z1. Thereafter, the valve assembly V2 is manipulated to open position, thus implosionly exposing the zone Z1 to the atmospheric chamber CH.

When it is desired to manipulate the flapper head 53 of the valve assembly V2 to open position to expose the production zone Z1 and the perforations P, together with the well bore immediately adjacent thereto to the low pressure chamber CH, pressure within the annulus between the casing C and the tubing string TS is increased, the increased pressure passing through the outer housing 10 by means of the port 33 within the connector 14, thence through the port 34 within the segment retainer 27.

It should be noted that since the effective piston areas across the rings 60 (in the piston head 59) and the rings 37 (in the segment retainer 27) are equal, pressure will act upon each of these piston areas simultaneously. However, the segment retainer 27 and the piston mandrel 58 will not move with respect to one another until such time as the increased annulus pressure causes the shear screw 29 tolerance to be overcome. When the shear screw 29 is sheared, the segment retainer 27 will be urged downwardly until its lower end 39 is shouldered upon the shoulder 40 of the connector 14. In this shifted position, the upper end 27A of the segment retainer 27 has passed below the lower end of the segments 26, and the segments 26 now are free to expand outwardly and away from the piston mandrel 58, thus freeing the piston mandrel 58 to travel longitudinally upwardly. Accordingly, as pressure is increased and transmitted through the ports 33 and 34, pressure will continue to act upon the piston head 59 until its upper end 62 rests upon the lower face 23 of the shock absorber 22. Now, correspondingly, the piston mandrel 58 has been shifted to the up position, releasing the flapper head 53 from its engaged or closed position upon the lip 52. As the flapper head 53 is manipulated to open position as the piston mandrel 58 is shifted upwardly, pressure within the chamber CH and pressure immediate the zone Z1 and below the chamber CH will begin to equalize, thus providing a vacuum-like action upon the perforation surfaces to remove particulate matter such as scale, corrosion, and the like, from clogged ports and passageways.

As the piston mandrel 58 is shifted to the "up" position within the outer housing 10, the limit pin 46 will encounter the limit lock 66 and the spring 47 surrounding the limit pin 46 will urge the limit pin 46 into the lock 66 to assure that the piston mandrel 58 is not inadvertently shifted downwardly subsequent to opening of the valve assembly V2.

After pressure has been equalized between the zone Z1 and the chamber CH and debris and contaminant have been removed from the surface of the perforations P, reverse circulation may be initiated by manipulating the upper valve assembly V1 to open position.

When it is desired to open the upper valve assembly V1 to, for example, provide a complete passage for reverse circulation to clean the well after the zone Z1 and the perforations P have been exposed to the chamber CH, pressure within the tubing string TS is increased and is transmitted through the port 137 and the passage 160. As pressure is increased, the strength of the shear pin 116 will be overcome and the pin 116 will shear, thus enabling the increased pressure to act upon the piston head 129 and shift the piston head 129 and piston assembly 128 longitudinally upward until the upper face 132 of the piston head 129 contacts the lower face 134 of the elastomeric shock absorber 133, whereby further upward longitudinal movement is prevented. As the piston 128 is shifted upwardly, the pin 138 and the groove 135 will come into latitudinal alignment and the spring 139 will cause the pin 138 to contract into locking engagement with the groove 135 and prevent downward longitudinal movement of the piston 128. As the piston 128 is shifted longitudinally upward, the lower end of the piston 128 will pass above the port 142 and the ring 117, exposing the interior 144 to the passage 143, and pressure will be permitted to equalize across the port 142. Since the passage 143 is always in communication with the interior of the chamber CH, the interior of the valve assembly V2, the external diameter around the packer PR and the internal diameter of the casing C immediate the perforations P, the zone Z1 may be placed in fluid communication with the tubing string TS to the top of the well by pulling the tubing string TS to sealingly disengage the packer P. Reverse circulation may be initiated in the annular area between the casing C and the backsurge assembly to wash the perforations P and the zone Z1. Consequently, fluid may be transmitted under pressure from the top of the well and the annular area between the casing C and the tubing string TS.

When the packer PR is released, fluid and pressure may be continued to be pumped in the annular area between the casing C and the packer PR to the zone Z1, thence through the open bottom end of the packer PR, through the bore of the packer PR, thence interiorly within the valve V2, through the chamber CH, into the passage 143 of the upper valve assembly V1, through the port 142, thence through the interior 144 of the upper valve assembly V1, and through the tubing string TS to the top of the well.

After the remedial operation has been conducted, the tubing string TS and the backsurge apparatus are removed from the well and production may be initiated through a production string, or the like.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A valve apparatus disposable in a tubing string in a subterranean well bore for performing pressure surging operations, wherein fluid is present in the annular area between the tubing string and the well bore, and fluid is present within the tubing string and wherein there is means for selectively pressurizing the annulus fluid and pressurizing the tubing fluid, comprising: packer means for separating the annulus fluid from the tubing fluid; a first valve body; means for connecting the first valve body to said tubing string in communication therewith; flapper valve head means carried within the first valve body normally blocking fluid flow through said first valve body and said tubing string; valve seat means for selective sealing engagement with said flapper valve head means carried on said first valve body; a first piston carried by the first valve body responsive to pressurization of the annulus fluid to shift said flapper valve head means away from sealing engagement with said valve seat means to allow fluid flow through said first valve body; a second tubular body having a central bore; means for connecting the second tubular body to said tubing string in communication therewith; first lock means within said second tubular body; seal means selectively sealingly lockable within said second tubular body and having second lock means carried thereon, said seal means preventing fluid flow through said central bore; a fluid by-pass on said second tubular body; second piston means carried on said second tubular body and selectively sealingly covering said bypass to prevent fluid communication through said by-pass, said second piston means being shiftably responsive to pressurization of the tubing fluid whereby said second piston means is shifted in a first direction to a first position to open said fluid bypass means and permit fluid communication therethrough; and a cylindrical tubular air chamber located between said first and second valve bodies and communicating with said valve bodies.

2. A valve apparatus disposable in a tubing string in a subterranean well bore for performing pressure surging operations, wherein fluid is present in the annular area between the tubing string and the well bore, and fluid is present within the tubing string and wherein there is means for selectively pressurizing the annulus fluid and pressurizing the tubing fluid, comprising: packer means for separating the annulus fluid from the tubing fluid; a first valve body; means for connecting the first valve body to said tubing string in communication therewith; flapper valve head means carried within the first valve body normally blocking fluid flow through said first valve body and said tubing string; valve seat means for selective sealing engagement with said flapper valve head means carried on said first valve body; a first piston carried by the first valve body responsive to pressurization of the annulus fluid to shift said flapper valve head means away from sealing engagement with said valve seat means to allow fluid flow through said first valve body; means carried by said valve body for locking engagement with said first piston after said flapper valve head means is shifted away from sealing engagement with said valve seat means to prevent longitudinal shifting of said first piston in a least one direction; a second tubular body having a central bore; means for connecting the second tubular body to said tubing string in communication therewith; first lock means within said second tubular body; seal means selectively sealingly lockable within said second tubular body and having second lock means carried thereon, said seal means preventing fluid flow through said central bore; a fluid by-pass on said second tubular body; second piston means carried on said second tubular body and selectively sealingly covering said by-pass to prevent fluid communication through said by-pass, said second piston means being shiftably responsive to pressurization of the tubing fluid whereby said second piston means is shifted in a first direction to a first position to open said fluid by-pass means and permit fluid communication therethrough; and a cylindrical tubular air chamber located between said first and second valve bodies and communicating with said valve bodies.

3. A valve apparatus disposable in a tubing string in a subterranean well bore for performing pressure surging operations, wherein fluid is present in the annular area between the tubing string and the well bore, and fluid is present within the tubing string and wherein there is means for selectively pressurizing the annulus fluid and pressurizing the tubing fluid, comprising: packer means for separating the annulus fluid from the tubing fluid; a first valve body; means for connecting the first valve body to said tubing string in communication therewith; flapper valve head means carried within the first valve body normally blocking fluid flow through said first valve body and said tubing string; valve seat means for selective sealing engagement with said flapper valve head means carried on said first valve body; a first piston carried by the first valve body responsive to pressurization of the annulus fluid to shift said flapper valve head means away from sealing engagement with said valve seat to allow fluid flow through said first valve body; a second tubular body having a central bore; means for connecting the second tubular body to said tubing string in communication therewith; first lock means within said second tubular body; seal means selectively sealingly lockable within said second tubular body and having second lock means carried thereon, said seal means preventing fluid flow through said central bore; a fluid by-pass on said second tubular body; second piston means carried on said second tubular body and selectively sealingly covering said by-pass to prevent fluid communication through said by-pass, said second piston means being shiftably responsive to pressurization of the tubing fluid whereby said second piston means is shifted in a first direction to a first position to open said fluid by-pass means and permit fluid communication therethrough; means for locking said second piston means in said first position; and a cylindrical tubular air chamber located between said first and second valve bodies and communicating with said valve bodies.

4. A valve apparatus disposable in a tubing string in a subterranean well bore for performing pressure surging operations, wherein fluid is present in the annular area between the tubing string and the well bore, and fluid is present within the tubing string and wherein there is means for selectively pressurizing the annulus fluid and pressurizing the tubing fluid, comprising: packer means for separating the annulus fluid from the tubing fluid; a first valve body; means for connecting the first valve body to said tubing string in communication therewith; flapper valve head means carried within the first valve body normally blocking fluid flow through said first valve body and said tubing string; valve seat means for selective sealing engagement with said flapper valve head carried on said first valve body; a first piston carried by the first valve body responsive to pressurization of the annulus fluid to shift said flapper valve head away from sealing engagement with said valve seat to allow fluid flow through said first valve body; means carried by said valve body for locking engagement with said first piston after said flapper valve head means is shifted away from sealing engagement with said valve seat means to prevent longitudinal shifting of said first piston in a least one direction; a second tubular body having a central bore; means for connecting the second tubular body to said tubing string in communication therewith; first lock means within said second tubular body; seal means selectively sealingly lockable within said second tubular body and having second lock means carried thereon, said seal means preventing fluid flow through said central bore; a fluid by-pass on said second tubular body; second piston means carried on said second tubular body and selectively sealingly covering said by-pass to prevent fluid communication through said by-pass, said second piston means being shiftably responsive to pressurization of the tubing fluid whereby said second piston means is shifted in a first direction to a first position to open said fluid by-pass means and permit fluid communication therethrough; means for locking said second piston means in said first position; and a cylindrical tubular air chamber located between said first and second valve bodies and communicating with said valve bodies.

5. A valve apparatus disposable in a tubing string in a subterranean well bore for performing pressure surging operations, wherein fluid is present in the annular area between the tubing string and the well bore, and fluid is present within the tubing string, wherein there is means for selectively pressurizing the annulus fluid and pressurizing the tubing fluid, and wherein packer means are provided for separating the annulus fluid from the tubing fluid, comprising: a first valve body; means for connecting the first valve body to said tubing string in communication therewith; flapper valve head means carried within the first valve body normally blocking fluid flow through said first valve body and said tubing string; valve seat means for selective sealing engagement with said flapper valve head carried on said first valve body; a first piston carried by the first valve body responsive to pressurization of the annulus fluid to shift said flapper valve head means away from sealing engagement with said valve seat means to allow fluid flow through said first valve body; a second tubular body having a central bore; means for connecting the second tubular body to said tubing string in communication therewith; first lock means within said second tubular body; seal means selectively sealingly lockable within said second tubular body and having second lock means carried thereon, said seal means preventing fluid flow through said central bore; a fluid by-pass on said second tubular body; second piston means carried on said second tubular body and selectively sealingly covering said by-pass to prevent fluid communication through said by-pass, said second piston means being shiftably responsive to pressurization of the tubing fluid whereby said second piston means is shifted in a first direction to a first position to open said fluid by-pass means and permit fluid communication therethrough; and a cylindrical tubular air chamber located between said first and second valve bodies and communicating with said valve bodies.

6. A valve apparatus disposable in a tubing string in a subterranean well bore for performing pressure surging operations, wherein fluid is present in the annular area between the tubing string and the well bore, and fluid is present within the tubing string and wherein there is means for selectively pressurizing the annulus fluid and pressurizing the tubing fluid, comprising: packer means for separating the annulus fluid from the tubing fluid; a first valve body; means for connecting the first valve body to said tubing string in communication therewith; flapper valve head means carried within the first valve body normally blocking fluid flow through said first valve body and said tubing string; valve seat means for selective sealing engagement with said flapper valve head carried on said first valve body; a first piston carried by the first valve body responsive to pressurization of the annulus fluid to shift said flapper valve head means away from sealing engagement with said valve seat means to allow fluid flow through said first valve body; a second tubular body having a central bore; means for connecting the second tubular body to said tubing string in communication therewith; first lock means within said second tubular body; seal means selectively sealingly lockable within said second tubular body and having second lock means carried thereon, said seal means preventing fluid flow through said central bore; a fluid by-pass on said second tubular body; second piston means carried on said second tubular body and selectively sealingly covering said by-pass to prevent fluid communication through said by-pass, said second piston means being shiftably responsive to pressurization of the tubing fluid whereby said second piston means is shifted in a first direction to a first position to open said fluid by-pass means and permit fluid communication therethrough; and a cylindrical tubular air chamber located between said first and second valve bodies and communicating with said valve bodies, said chamber defining an atmospheric pressure area for effecting pressure surging of said well bore when said flapper valve head means is shifted away from sealing engagement with said valve seat means.

* * * * *